US011805902B2

(12) United States Patent
Del Vecchio et al.

(10) Patent No.: US 11,805,902 B2
(45) Date of Patent: Nov. 7, 2023

(54) HEIGHT ADJUSTABLE WORKSTATION WITH ZERO IDLE POWER

(71) Applicant: Ergotron, Inc., St. Paul, MN (US)

(72) Inventors: Dominic A. Del Vecchio, Eagan, MN (US); William Dale Tischer, Shoreview, MN (US); Mustafa Ergun, Eden Prairie, MN (US); Mark Alan Kottman, Minneapolis, MN (US); Shaun Christopher Lindblad, Inver Grove Heights, MN (US); Matthew J. Janechek, Maplewood, MN (US); Charles S. Christ, Jr., Deephaven, MN (US)

(73) Assignee: Ergotron, Inc., St. Paul, MN (US)

( * ) Notice: Subject to any disclaimer, the term of this patent is extended or adjusted under 35 U.S.C. 154(b) by 72 days.

(21) Appl. No.: 17/605,906

(22) PCT Filed: Apr. 23, 2020

(86) PCT No.: PCT/US2020/029597
§ 371 (c)(1),
(2) Date: Oct. 22, 2021

(87) PCT Pub. No.: WO2020/219732
PCT Pub. Date: Oct. 29, 2020

(65) Prior Publication Data

US 2022/0211170 A1 Jul. 7, 2022

Related U.S. Application Data

(60) Provisional application No. 62/838,488, filed on Apr. 25, 2019.

(51) Int. Cl.

| | |
|---|---|
| ***A47B 9/20*** | (2006.01) |
| ***A47B 9/16*** | (2006.01) |
| *A47B 9/00* | (2006.01) |

(52) U.S. Cl.
CPC ..... *A47B 9/20* (2013.01); *A47B 9/16* (2013.01); *A47B 2009/003* (2013.01); *A47B 2200/0075* (2013.01); *A47B 2220/0097* (2013.01)

(58) Field of Classification Search
CPC .... A47B 9/20; A47B 9/00; A47B 9/16; A47B 2200/0075; A47B 2200/0078; A47B 2200/01
(Continued)

(56) References Cited

U.S. PATENT DOCUMENTS

| | | | |
|---|---|---|---|
| 5,528,449 | A | 6/1996 | Koch |
| 6,237,507 | B1 | 5/2001 | Yanagisawa et al. |

(Continued)

FOREIGN PATENT DOCUMENTS

| | | | |
|---|---|---|---|
| CN | 201734188 | U | 2/2011 |
| CN | 202233896 | U | 5/2012 |

(Continued)

OTHER PUBLICATIONS

"International Application Serial No. PCT/US2020/029597, International Search Report dated Jul. 2, 2020", 2 pgs.

(Continued)

*Primary Examiner* — Jose V Chen
(74) *Attorney, Agent, or Firm* — Schwegman Lundberg & Woessner, P.A.

(57) ABSTRACT

An electric assisted height adjustable workstation featuring an integrated user interface for height adjustment and power control resulting in zero standby power consumption is described. Power is connected to the workstation via a physical movement of the integrated user interface causing an integrated connector to complete a circuit. Power is disconnected between the power source and the workstation via physical retraction of the integrated UI or an automatic
(Continued)

retraction if the user interface remains inactive for a period of time.

17 Claims, 15 Drawing Sheets

(58) Field of Classification Search
USPC ..... 108/144.11, 147
See application file for complete search history.

(56) References Cited

U.S. PATENT DOCUMENTS

| | | | | |
|---|---|---|---|---|
| 6,286,440 | B1 | 9/2001 | Jyringi | |
| 6,567,078 | B2 | 5/2003 | Ogawa | |
| 6,690,132 | B2 | 2/2004 | Koch | |
| 6,748,542 | B2 | 6/2004 | Box | |
| 7,361,051 | B2 | 4/2008 | Gorman | |
| 7,827,922 | B2 * | 11/2010 | Keil | A61D 3/00 119/753 |
| 8,072,181 | B2 | 12/2011 | Koch | |
| 8,241,101 | B2 | 8/2012 | Nordahl et al. | |
| 8,441,782 | B2 | 5/2013 | Thomas | |
| 8,581,436 | B2 | 11/2013 | Kristensen | |
| 8,723,957 | B2 | 5/2014 | Kim et al. | |
| 8,860,683 | B2 | 10/2014 | Baumbach | |
| 8,884,896 | B2 | 11/2014 | Tabone et al. | |
| 8,919,264 | B1 * | 12/2014 | Lager | A47B 9/04 108/108 |
| 8,947,215 | B2 * | 2/2015 | Mandel | G06Q 10/109 248/188.4 |
| 9,084,475 | B2 | 7/2015 | Hjelm | |
| 9,128,707 | B2 | 9/2015 | Baba et al. | |
| 9,236,822 | B2 | 1/2016 | Hille et al. | |
| 9,282,814 | B2 | 3/2016 | Riley et al. | |
| 9,298,318 | B2 | 3/2016 | Morrison et al. | |
| 9,510,428 | B2 | 11/2016 | Mix et al. | |
| 9,660,483 | B2 | 5/2017 | Kim et al. | |
| 9,678,559 | B1 | 6/2017 | Devries et al. | |
| 9,690,396 | B1 | 6/2017 | Kubica | |
| 10,002,723 | B2 | 6/2018 | Balgheim et al. | |
| 10,485,335 | B1 * | 11/2019 | Johnson | F16M 11/28 |
| 2003/0154890 | A1 * | 8/2003 | Warner | A47B 9/00 108/145 |
| 2006/0081586 | A1 | 4/2006 | Ramsay | |
| 2006/0267952 | A1 | 11/2006 | Alcorn | |
| 2009/0185403 | A1 | 7/2009 | Koch | |
| 2010/0007801 | A1 | 1/2010 | Cooper et al. | |
| 2010/0176762 | A1 | 7/2010 | Daymude et al. | |
| 2010/0188229 | A1 | 7/2010 | Nhep | |
| 2011/0247532 | A1 * | 10/2011 | Jones | A47B 9/02 108/147.22 |
| 2012/0000911 | A1 | 1/2012 | Wang | |
| 2012/0105332 | A1 | 5/2012 | Aumiller et al. | |
| 2013/0199419 | A1 | 8/2013 | Hjelm | |
| 2013/0199420 | A1 * | 8/2013 | Hjelm | A47B 21/00 108/50.11 |
| 2014/0144352 | A1 * | 5/2014 | Roberts | A47B 21/0314 108/147 |
| 2016/0128467 | A1 * | 5/2016 | Sigal | A47B 9/00 700/275 |
| 2016/0170402 | A1 * | 6/2016 | Lindstrom | G05B 19/402 700/275 |
| 2016/0278514 | A1 | 9/2016 | Maas | |
| 2016/0370836 | A1 | 12/2016 | Gelonese | |
| 2017/0042322 | A1 | 2/2017 | Labrosse et al. | |
| 2017/0201094 | A1 | 7/2017 | Hassan | |
| 2018/0011530 | A1 | 1/2018 | Gelonese | |
| 2018/0168334 | A1 * | 6/2018 | Swartz | F16M 11/046 |
| 2018/0184799 | A1 | 7/2018 | Lin | |
| 2018/0279772 | A1 | 10/2018 | Ergun et al. | |
| 2019/0059573 | A1 | 2/2019 | Tseng et al. | |
| 2019/0082823 | A1 | 3/2019 | Applegate et al. | |
| 2019/0183239 | A1 * | 6/2019 | Semmelrath | A47B 9/16 |
| 2019/0246789 | A1 * | 8/2019 | Chen | A47B 21/02 |
| 2019/0252902 | A1 * | 8/2019 | Koch | H02J 50/10 |
| 2019/0298055 | A1 * | 10/2019 | Yamamoto | A47B 9/00 |
| 2019/0365090 | A1 * | 12/2019 | Oakley | B60B 33/0078 |
| 2020/0196747 | A1 * | 6/2020 | Lu | A47B 9/00 |
| 2020/0390234 | A1 * | 12/2020 | Smed | A47B 21/02 |
| 2021/0030146 | A1 * | 2/2021 | Riebner | A47B 9/00 |
| 2021/0100353 | A1 * | 4/2021 | Olesen | G05B 19/19 |
| 2021/0100354 | A1 * | 4/2021 | Mçller | A47B 9/20 |
| 2021/0145164 | A1 * | 5/2021 | Lu | A47B 9/16 |
| 2021/0239459 | A1 * | 8/2021 | Lukas | A47B 9/20 |
| 2021/0318724 | A1 * | 10/2021 | Sung | B62B 3/02 |
| 2021/0329408 | A1 * | 10/2021 | Spahn | H04W 4/33 |
| 2021/0386193 | A1 * | 12/2021 | Bucquet | A47C 31/126 |
| 2022/0192364 | A1 * | 6/2022 | Knapp | A47B 21/02 |

FOREIGN PATENT DOCUMENTS

| | | | | |
|---|---|---|---|---|
| CN | 102940391 | A | 2/2013 | |
| CN | 103027493 | A | 4/2013 | |
| CN | 203814868 | U | 9/2014 | |
| CN | 203986825 | U | 12/2014 | |
| CN | 206091714 | U | 4/2017 | |
| CN | 107232773 | A | 10/2017 | |
| CN | 113766856 | A | 12/2021 | |
| CN | 113766856 | B | 4/2023 | |
| EP | 0615667 | B2 | 10/2001 | |
| EP | 1978618 | A1 | 10/2008 | |
| EP | 2454969 | A1 | 5/2012 | |
| JP | 2012138030 | A | 7/2012 | |
| WO | WO-2006092354 | A1 | 9/2006 | |
| WO | WO-2007107157 | A1 | 9/2007 | |
| WO | WO-2010054656 | A1 | 5/2010 | |
| WO | WO-2011134612 | A2 | 11/2011 | |
| WO | WO-2012028016 | A1 | 3/2012 | |
| WO | WO-2012113912 | A1 | 8/2012 | |
| WO | WO-2616001421 | A1 | 1/2016 | |
| WO | WO-2018210386 | A1 | 11/2018 | |
| WO | WO-2018223240 | A1 | 12/2018 | |
| WO | WO-2018223240 | A1 * | 12/2018 | A47B 13/06 |
| WO | WO-2020219732 | A1 | 10/2020 | |
| WO | WO-2020219740 | A1 | 10/2020 | |

OTHER PUBLICATIONS

"International Application Serial No. PCT/US2020/029597, Written Opinion dated Jul. 2, 2020", 8 pgs.
"International Application Serial No. PCT/US2020/029609, International Search Report dated Jul. 15, 2020", 2 pgs.
"International Application Serial No. PCT/US2020/029609, Written Opinion dated Jul. 15, 2020", 7 pgs.
"Chinese Application Serial No. 202080031045.9, Office Action dated Aug. 10, 2022", w/English Translation, 28 pgs.
"Chinese Application Serial No. 202080031045.9, Response filed Nov. 30, 2022 to Office Action dated Aug. 10, 2022", w/ English Claims, 15 pgs.
"International Application Serial No. PCT/US2020/029597, International Preliminary Report on Patentability dated Nov. 4, 2021", 10 pgs.
"International Application Serial No. PCT/US2020/029609, International Preliminary Report on Patentability dated Nov. 4, 2021", 9 pgs.
"Mexican Application Serial No. MX/a/2021/013032, Office Action dated Nov. 25, 2021".

* cited by examiner

HEIGHT ADJUSTABLE WORKSTATION WITH ZERO IDLE POWER

CLAIM OF PRIORITY

This patent application is a U.S. NSPCT Application claiming the benefit of priority to PCT Application Serial No. PCT/US2020/029597, entitled "HEIGHT ADJUSTABLE WORKSTATION WITH ZERO IDLE POWER," filed on Apr. 23, 2020, and published as WO 2020/219732 A1 on Oct. 29, 2020, which claims the benefit of priority of Del Vecchio, et al. U.S. Provisional Patent Application Ser. No. 62/838,488, entitled "HEIGHT ADJUSTABLE WORKSTATION WITH ZERO IDLE POWER," filed on Apr. 25, 2019, which are hereby incorporated by reference herein in their entirety.

TECHNICAL FIELD

This document pertains generally, but not by way of limitation, to height adjustable workstations.

BACKGROUND

Workstations can be freestanding (e.g., supported by a floor or by a desktop), coupled to a structure (e.g., a wall), or mobile (e.g., attached to a wheeled base). The workstation can include a work surface, and the work surface can allow a user to accomplish one or more tasks (e.g., writing, typing, manufacturing operations, or the like). The workstation can include either a mechanical height adjustment mechanism (e.g., a linkage, a gas spring, an extension spring, or the like), or a motorized height adjustment mechanism (e.g., an electric motor).

BRIEF DESCRIPTION OF THE DRAWINGS

The following drawings are illustrative of particular embodiments of the present invention and therefore do not limit the scope of the invention. The drawings are not to scale and are intended for use in conjunction with the explanations in the following detailed description. Embodiments of the present invention will hereinafter be described in conjunction with the appended drawings. The drawings illustrate generally, by way of example, but not by way of limitation, various embodiments discussed in the present document.

OVERVIEW

This disclosure is directed to a motorized height adjustable workstation. More particularly, the workstation can include a connector to disconnect power from the height adjustment mechanism when the height adjustment mechanism is idle to eliminate any power consumption.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

A height of a work surface can be adjustable with respect to a user (e.g., the user is able to raise and lower the work surface). A height adjustment mechanism (e.g., a mechanical counterbalance mechanism such as a spring/cam assembly or a linkage assembly, or an electrical mechanism such as an electric motor) can be connected to the work surface. The height adjustment mechanism can support the work surface, such as by helping the user adjust the work surface height, and thereby reducing the effort required by the user to adjust the work surface height.

In some example configurations, an electric motor can be connected to the work surface to provide height adjustment for the work surface. As discussed in further detail in this disclosure, a mechanically actuated connector assembly can be connected to a controller for the electric motor to selectively connect and disconnect the power to the electric motor. The mechanically actuated connector assembly can engage the powered configuration to connect power to the electric motor to move the worksurface, and the mechanically actuated connector assembly can disengage the powered configuration to disconnect power to the electric motor to prevent any power loss when the work surface is idle.

Figure 1:
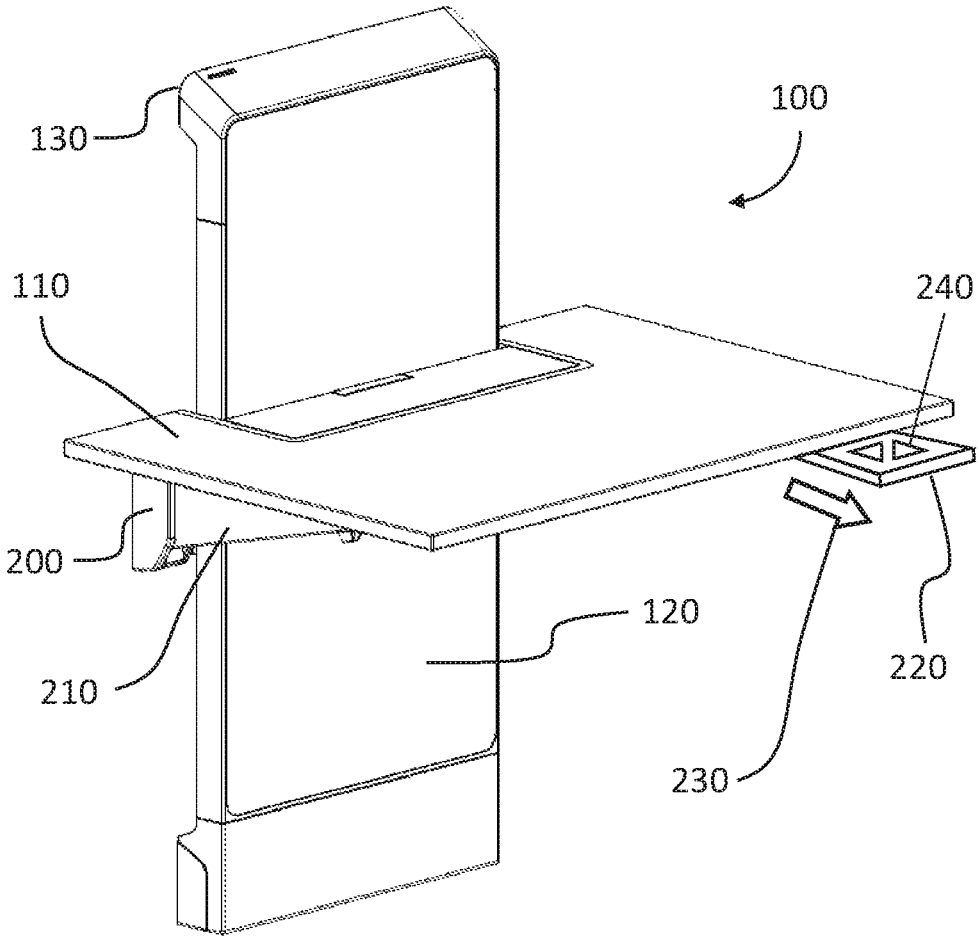
FIG. 1 is a perspective view of one example of a height adjustable workstation.

FIG. 1 is a perspective view of one example of a height adjustable platform 100. The height adjustable platform 100 can include a work surface 110 and can include a support leg. The support leg can be a fixed height riser 120 as illustrated in FIG. 1. The riser 120 can be adapted to couple with a support structure 130 (e.g., a wall, a cubicle wall, a free-standing frame, or the like). The riser 120 can define mounting holes adapted to couple the riser 120 with the support structure 130. The work surface 110 can be coupled with the riser 120 such that the work surface 110 is able to translate with respect to the riser 120.

The height adjustable platform 100 can include a sliding bracket 200. The sliding bracket 200 can be moveably coupled with the riser 120 such that the sliding bracket 200 is adapted to translate with respect to the riser 120.

The height adjustable platform 100 can further include a support bracket 210. The support bracket 210 can be coupled with the sliding bracket 200. The support bracket 210 can be adapted to couple with the work surface 110. Coupling the work surface 110 to the support bracket 210 can help the work surface 110 translate with respect to the riser 120.

A portion of the sliding bracket 200 can engage with a portion of the riser 120, and thereby movably couple the sliding bracket 200 with the riser 120. As described in this disclosure, the sliding bracket 200 can translate with respect to the riser 120, e.g., linear translation, which can change the height of the sliding bracket 200 (and components attached to the sliding bracket, such as the work surface 110 of FIGS. 1-2).

In an example configuration, riser 120 can include an electric motor (not shown in FIG. 1). The electric motor can be coupled to a linear actuator (not shown in FIG. 1). The linear actuator can be connected to the sliding bracket 200. The electric motor can be adapted to drive the linear actuator to move the sliding bracket 200. A controller (not shown in FIG. 1) can be connected to the workstation 100. The controller can include an AC/DC converter, a height adjustment controller, and a timer controller. The controller can be adapted to control the power distribution within the workstation 100 and control the height adjustment of the work surface 110.

At least one mechanically actuated connector 220 can be connected to the work surface for operational control of the electric motor. The mechanically actuated connector 220 can be coupled to the controller. The connection between the power source and the controller can be provided via the mechanically actuated connector 220. The mechanically actuated connector 220 can be in a connected state to connect the power source to the controller, and in a disconnected state to disconnect the power source from the controller. For example, the user of the workstation can manipulate the mechanically actuated connector 220, such as sliding the connector 220 in a first direction 230 to establish a first state, e.g. a connected state, and the user of the workstation can manipulate the mechanically actuated connector 220, such as sliding the connector 220 in a second direction opposite the first direction 220, to establish a second state, e.g., a disconnected state. It will be apparent from this disclosure that other techniques can be used to manipulate the mechanically actuated connector to alternate between the connected state and the disconnected state. When the mechanically actuated connector 220 is in the connected state, a height adjustment user interface 240 can also be exposed, e.g., simultaneously, allowing the user to adjust the height of the worksurface 110. For example, the height adjustment user interface 240 can be coupled to the mechanically actuated connector 220, e.g., a top surface of the connector 220, such that when the connector 220 is pulled or slid in the direction 230, the user interface is revealed to the user.

Figure 2:
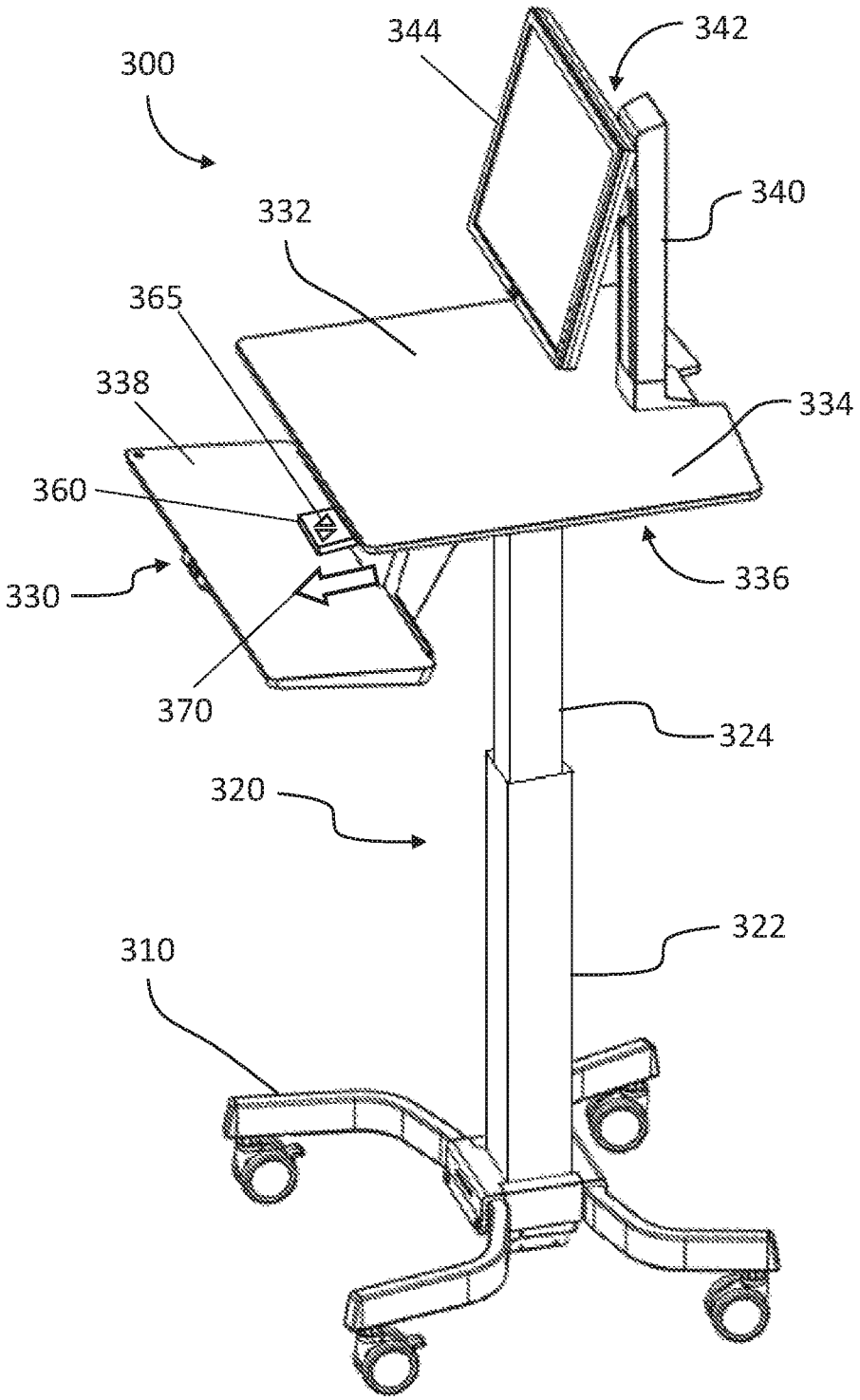
FIG. 2 is a perspective view of another example of a height adjustable workstation.

FIG. 2 is a perspective view of an example of a mobile workstation that can implement various techniques of this disclosure. The mobile workstation 300 can include a base 310, e.g., a wheeled base, a support leg 320, e.g., a telescoping head unit riser, a head unit assembly 330, and a display riser 340, e.g., for mounting electronic display to the mobile workstation. In the example configuration shown in FIG. 2, the head unit riser 320 can be a two-member telescoping column, including a first member 322, and a second member 324. The first member 322 can be attached to the wheeled base 310, and the second member 324 can be slidingly engaged with the first member 322. The head unit assembly 330 can be connected to the upper end of the telescoping column formed by members 322-324. A height of the worksurface 332 can be changed by extending and retracting the second member 324 relative to the first member 322. In the example configuration shown in FIG. 2, the telescoping column 320 is shown in an extended configuration.

The head unit assembly 330 can include a planar work surface 332 having an upper surface 334 and a lower surface 336. The display riser 340 can be coupled to the worksurface 332. Display riser 340 can include a display mount 342 to hold a display 344 above the worksurface 332. A keyboard tray 338 can be connected to the lower surface 336. In some example configurations, the keyboard tray 338 can be slidingly engaged with the worksurface 332, and it can be height adjustable relative to the worksurface 332.

In an example configuration, the telescoping riser 320 can include an electric motor (not shown in FIG. 2). The electric motor can be connected to the first member 322 and coupled to a linear actuator (not shown in FIG. 2). The linear actuator can be connected to the second member 324. The electric motor can be adapted to drive the linear actuator to move the second member 324. A controller (not shown in FIG. 2) can be connected to the workstation 300. The controller can include an AC/DC converter, a height adjustment controller, and a timer controller. The controller can be adapted to control the power distribution within the workstation 300 and control the height adjustment of the worksurface 334. At least one mechanically actuated connector 360 can be connected to the work surface 332 for operational control of the electric motor. In other example configurations, the mechanically actuated connector 360 can be connected to the keyboard tray 338.

The mechanically actuated connector 360 can be coupled to the controller. The connection between the power source (not shown in FIG. 2) and the controller can be provided via the mechanically actuated connector 360. The mechanically actuated connector 360 can be in a connected state to connect the power source to the controller, and in a disconnected state to disconnect the power source from the controller. The user of the workstation can manipulate the mechanically actuated connector 360, such as sliding the connector 360 in a first direction 370 to establish a first state, e.g. a connected state, and the user of the workstation can manipulate the mechanically actuated connector 360, such as sliding the connector 360 in a second direction opposite the first direction 370 to establish a second state, e.g., a disconnected state. Other techniques can be used to manipulate the mechanically actuated connector to alternate between the connected state and the disconnected state, as described below. When the mechanically actuated connector 360 is in the connected state, a height adjustment user interface 365 can also be exposed, e.g., on a top surface of the connector 360, thereby allowing the user to adjust the height of the worksurface 332. In some example configurations, the user of the workstation can expose the height adjustment user interface 365 simultaneously when the user of the workstation manipulates the mechanically actuated connector 360.

Figure 3:
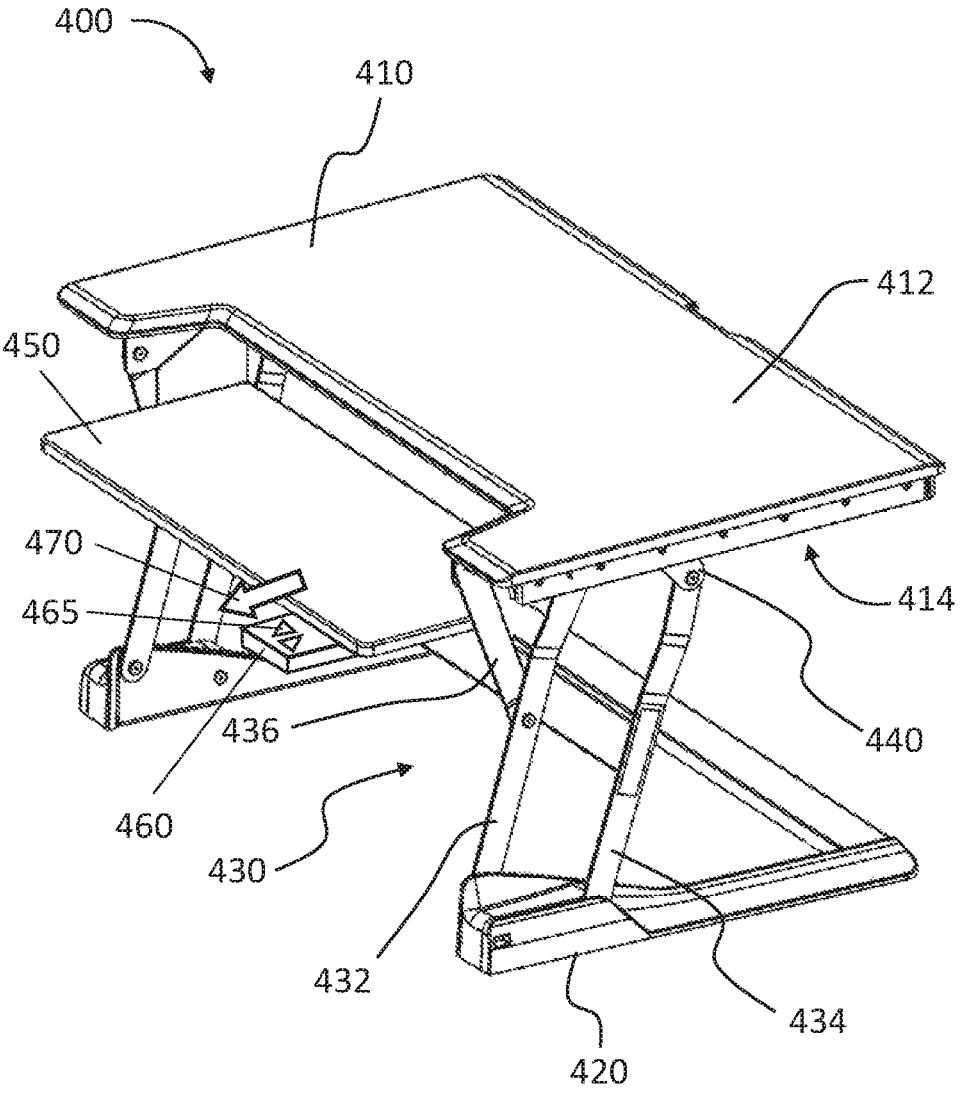
FIG. 3 is a perspective view of yet another example of a height adjustable workstation.

FIG. 3 is a perspective view of another example of a height adjustable workstation. The height adjustable workstation 400 can include a work surface 410 and a foot assembly 420. The foot assembly 420 can be adapted to rest upon a foundation (e.g., a floor, a desktop, or the like). The height adjustable workstation 400 can implement various techniques of this disclosure.

The height adjustable workstation 400 can include at least one support leg 430, e.g., a linkage assembly. In some example configurations, the linkage assembly 430 can include a first linkage arm 432, a second linkage arm 434, and a transverse linkage arm 436. At least one linkage assembly 430 can couple the work surface 410 to the foot assembly 420. The linkage assembly 430 can be configured such that displacement of the linkage assembly 430 can adjust a height of the work surface 410 relative to the foot assembly 420.

The work surface 410 can define a top surface 412 and an underside 414. At least one gliding bracket 440 can be slidingly coupled to the underside 414 of the work surface 410. The first linkage arm 432 and the second linkage arm 434 can be rotatingly coupled to the foot assembly 420 on one end and rotatingly coupled to the gliding bracket 440 on the other end. One end of the transverse linkage arm 436 can be rotatingly coupled to the underside 414 of the work surface 410, and the other end of the transverse linkage 436 can be rotatingly coupled to the first linkage arm 432. The gliding bracket 440 can be configured to slide relative to the work surface 410 as the first and second linkage arms are displaced.

A keyboard tray 450 can be connected to the underside 414 of the worksurface 410. In some example configurations, the keyboard tray 450 can be slidingly engaged with the work surface 410, and it can be height adjustable relative to the work surface 410.

In an example configuration, the height adjustable workstation 400 of FIG. 3 can include an electric motor (not shown in FIG. 3). The electric motor can be attached to the underside 414 of the work surface 410, and the electric motor can be coupled to a linear actuator (not shown in FIG. 3). The linear actuator can be connected to the gliding bracket 440. The electric motor can be adapted to drive the linear actuator to move the gliding bracket 440. A controller (not shown in FIG. 3) can also be connected to the workstation 400. The controller can include an AC/DC converter, a height adjustment controller, and a timer controller. The controller can be adapted to control the power distribution within the workstation 400 and control the height adjustment of the work surface 410. At least one mechanically actuated connector 460 can be connected to the keyboard tray 450 for operational control of the electric motor. In other example configurations, the mechanically actuated connector 460 can be connected to the underside 414 of the work surface 410.

The mechanically actuated connector 460 can be coupled to the controller. The connection between the power source and the controller can be provided via the mechanically actuated connector 460. The mechanically actuated connector 460 can be in a connected state to connect the power source to the controller, and in a disconnected state to disconnect the power source from the controller. The user of the workstation can manipulate the mechanically actuated connector 460, such as sliding the connector 460 in a first direction 470 to establish a first state, e.g., a connected state, and the user of the workstation can manipulate the mechanically actuated connector 460, such as sliding the connector 460 in a second direction opposite the first direction 470 to establish a second state, e.g., a disconnected state. It will be apparent from this disclosure that other techniques can also be possible to manipulate the mechanically actuated connector to alternate between connected state and disconnected state. When the mechanically actuated connector 460 is manipulated to connect the power source to be in the connected state, a height adjustment user interface 465 can also be exposed, e.g., simultaneously, allowing the user to adjust the height of the work surface 410.

Figure 4:
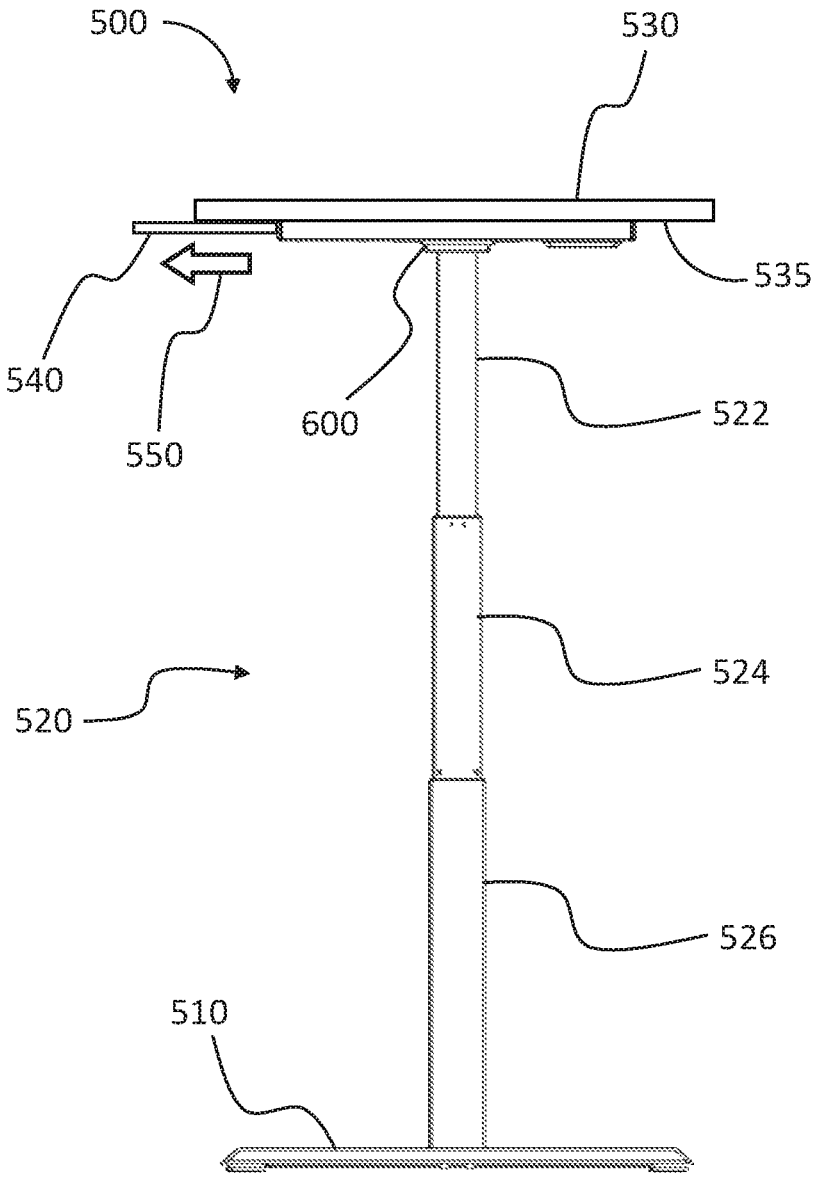
FIG. 4 is a side view of yet another example of a height adjustable workstation in an elevated position.

FIG. 4 is a side view of another example of a height adjustable workstation. The height adjustable workstation 500 can include a base 510, at least one support leg 520, e.g., a telescoping riser, and a work surface 530. The base 510 can be adapted to rest upon a foundation (e.g., a floor, a desktop, or the like). The height adjustable workstation 500 can implement various techniques of this disclosure.

In the example configuration, at least one riser 520 can be a three-member telescoping column as illustrated in FIG. 4. The riser 520 can including a first member 522, a second member 524, and a third member 526. The third member 526 can be attached to the base 510, the second member 524 can be slidingly engaged with the third member 526, and the first member 522 can be slidingly engaged with the second member 526.

The work surface 530 can be connected to the upper end of the telescoping riser 520 formed by members 522, 524, and 526. A height of the work surface 530 can be changed relative to the base by expanding and contracting the riser 520. In example configurations shown in FIGS. 4 and 5, telescoping riser 520 is shown in expanded and contracted configurations, respectively. An example of a three-member telescoping configuration is shown and described in commonly assigned U.S. Pat. No. 9,232,855 to Mustafa Ergun et al., the entire contents of which being incorporated herein by reference, specifically the portions related to FIGS. 1-8B and FIGS. 39-42.

In an example configuration, the riser 520 can include an electric motor 600. The electric motor 600 can be attached to the first member 522 and coupled to a linear actuator (not shown in FIG. 4). The linear actuator can be connected to the second member 524. The electric motor can be adapted to drive the linear actuator to move the second member 524 relative to the first member 522. A controller (not shown in FIG. 4) can be connected to the workstation 500. The controller can include an AC/DC converter, a height adjustment controller, and a timer controller. The controller can be adapted to control the power distribution within the workstation 500 and control the height adjustment of the work surface 530. At least one mechanically actuated connector 540 can be connected to the work surface 530 for operational control of the electric motor.

Figure 5:
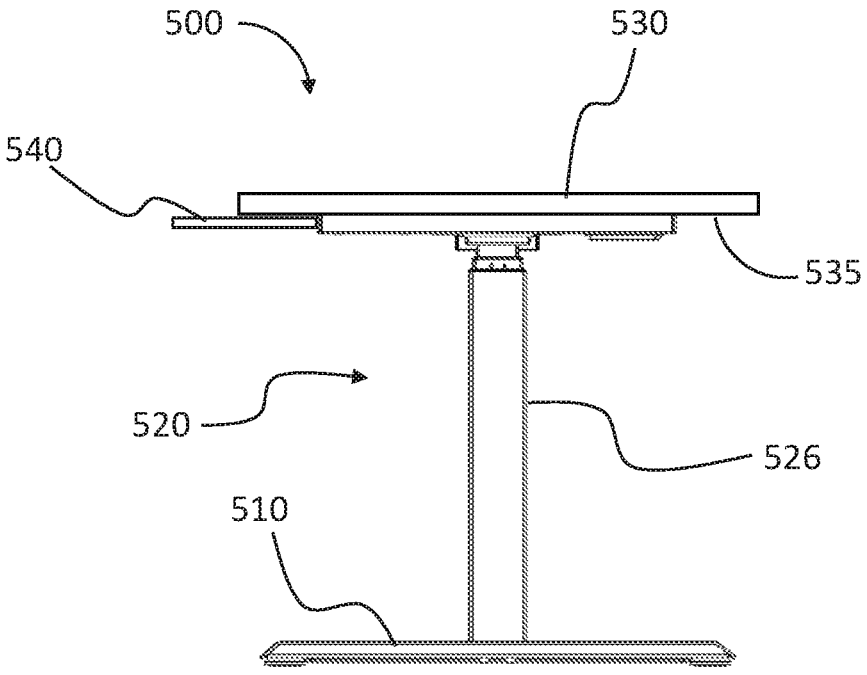
FIG. 5 is a side view of the height adjustable workstation of FIG. 4 in a contracted position.
Figure 6:
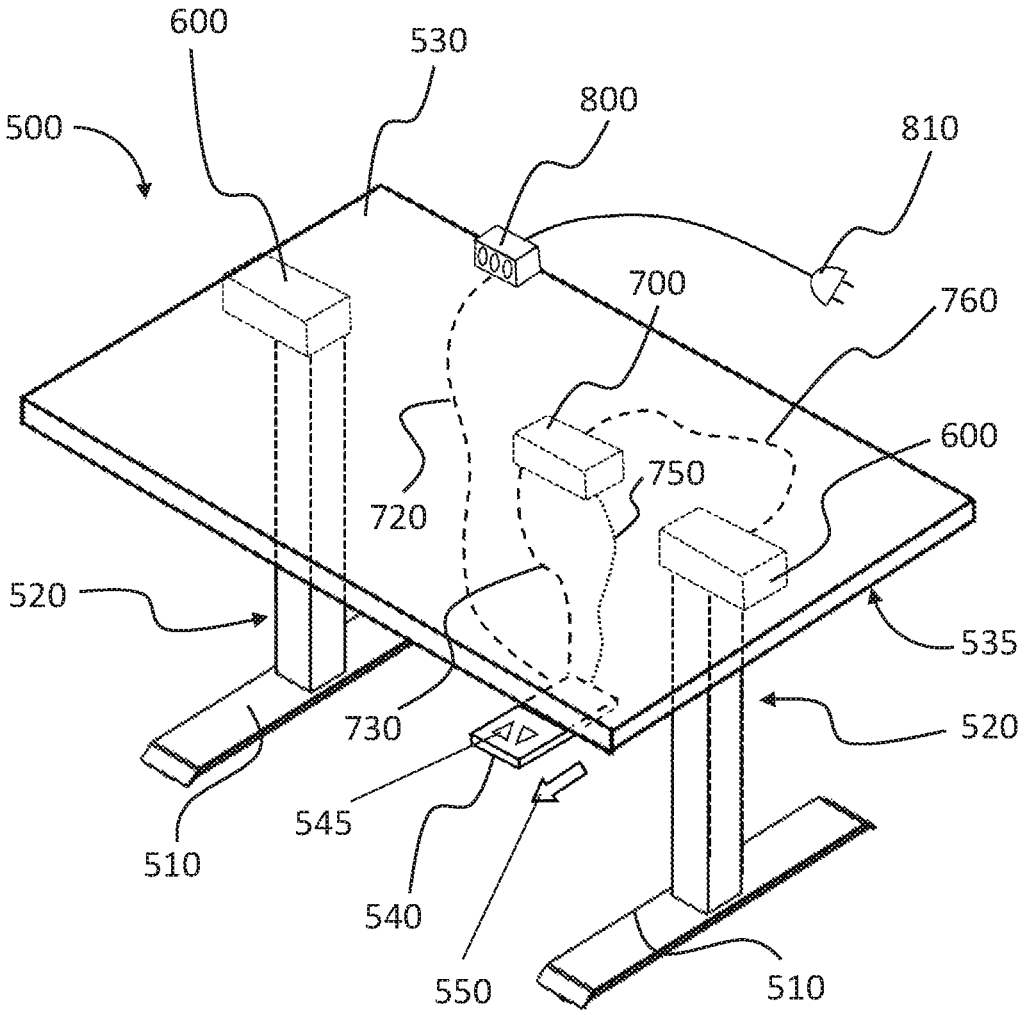
FIG. 6 is a perspective view of the height adjustable workstation of FIG. 5, with illustration of some of the electrical components and an example of a mechanically actuated connector for height adjustment.

FIG. 6 is a perspective view of the workstation 500 of FIG. 5. Two sets of legs including telescoping risers 520 and bases 510 can be connected to the work surface 530 to form the height adjustable workstation 500. An electric motor 600 can be connected to each of the telescoping legs 520. A linear actuator (not shown) can be contained inside each of the telescoping risers 520. The electric motors 600 can drive the linear actuators to expand or contract each telescoping riser 520 simultaneously to adjust a height of the work surface 530 relative to the base 510.

A mechanically actuated connector 540 can be connected to the workstation 500. In an example configuration, the mechanically actuated connector 540 can be slidingly connected to an underside 535 of the work surface 530 as illustrated in FIG. 6. The workstation 500 can further include a controller 700. The controller can include an AC/DC converter, a height adjustment controller, and a timer controller. The controller can be adapted to control the power distribution within the workstation 500 and control the height adjustment of the work surface 530.

Figure 7:
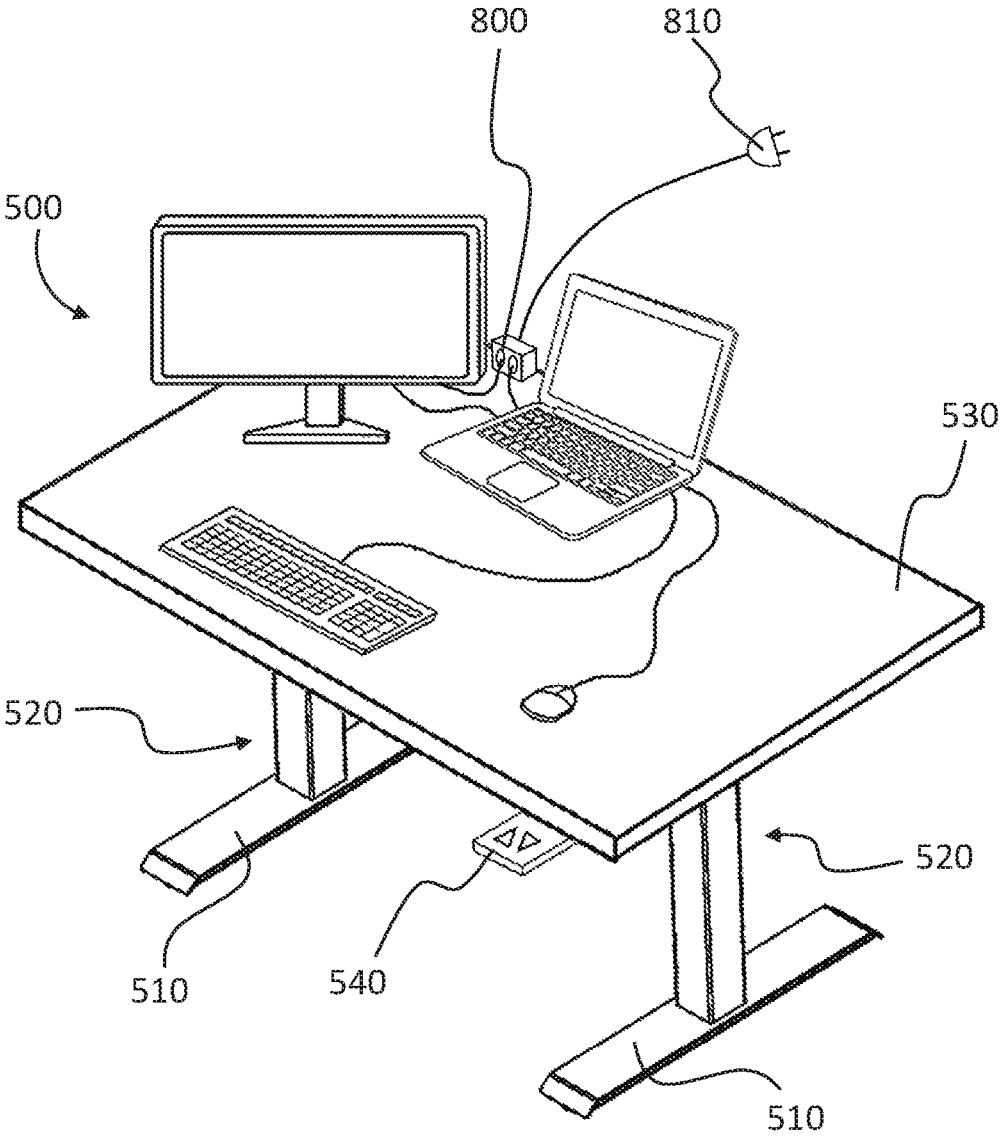
FIG. 7 is a perspective view of the height adjustable workstation of FIG. 6, with illustration of sample desktop electronic devices.

The workstation 500 can further include a power plug 810. The power plug 810 can be connected to a power source to provide power to the workstation 500. In some sample configurations, the workstation 500 can include an outlet box 800. The outlet box can be connected to the power source through the power plug 810. The outlet box 800 can include at least one socket. One or more electronic devices located on the workstation can be connected to the sockets located on the outlet box 800 to receive power as illustrated in FIG. 7.

In an example configuration, the mechanically actuated connector 540 can receive electric power through the first power line 720. In some configurations, the first power line 720 can be connected to the outlet box 800, or in other configurations, the first power line 720 can be directly connected to the power plug 810. The mechanically actuated connector 540 can be connected to the controller 700 to provide electric power to the controller 700, and to provide a first signal to activate the electric motor 600. Electric power can be provided to the controller 700 via the second power line 730, and the first signal to activate the electric motor can be sent to the controller via the first signal line 750. Electric power can be provided to the electric motor 600 via a third power line 760 which can be connected between the controller 700 and the electric motor 600.

The mechanically actuated connector 540 can be in a connected state to connect the power source to the controller 700, and the mechanically actuated connector 540 can be in a disconnected state to disconnect the power source from the controller. The user of the workstation can manipulate the mechanically actuated connector 540, such as sliding the connector 540 in a first direction 550 to establish a first state, e.g., a connected state, and the user of the workstation can manipulate the mechanically actuated connector 540, such as sliding the connector 540 in a second direction opposite the first direction 550, to establish a second state, e.g., a disconnected state. The mechanically actuated connector 540 can be slidably connected at an underside 535 of the work surface 530. When the mechanically actuated connector 540 is retracted (e.g., slide in a second direction opposite the first direction 550 to be stowed under the work surface 530), the mechanically actuated connector 540 can be in a disconnected state. In the disconnected state, no power can be supplied to the controller 700. When the mechanically actuated connector 540 is extracted (e.g., slide in the first direction 550 to be at least partially pulled out from under the work surface 530), the mechanically actuated connector 540 can be in a connected state. In the connected state, electric power can be supplied to the controller 700. It will be apparent from this disclosure that other techniques can also be possible to manipulate the mechanically actuated connector 540 to alternate between connected state and disconnected state.

When the mechanically actuated connector 540 is manipulated (for example slid in a first direction 550) to achieve a connected state, a height adjustment user interface 545 can also be exposed, e.g., simultaneously, allowing the user to adjust a height of the work surface 530. The height adjustment user interface 545 can include a first button and a second button. The first button can be used to move the work surface 530 away from the base 510 by expanding the telescoping riser 520, and the second button can be used to move the work surface 530 towards the base 510 by contracting the telescoping riser 520. When the user interacts with the height adjustment user interface 545, a first signal can be sent to the controller 700 via the first signal line 750. The controller 700 then can supply power to the electric motor 600 via the third power line 760 to move the work surface 530 in a desired direction (e.g., up or down).

Figure 8:
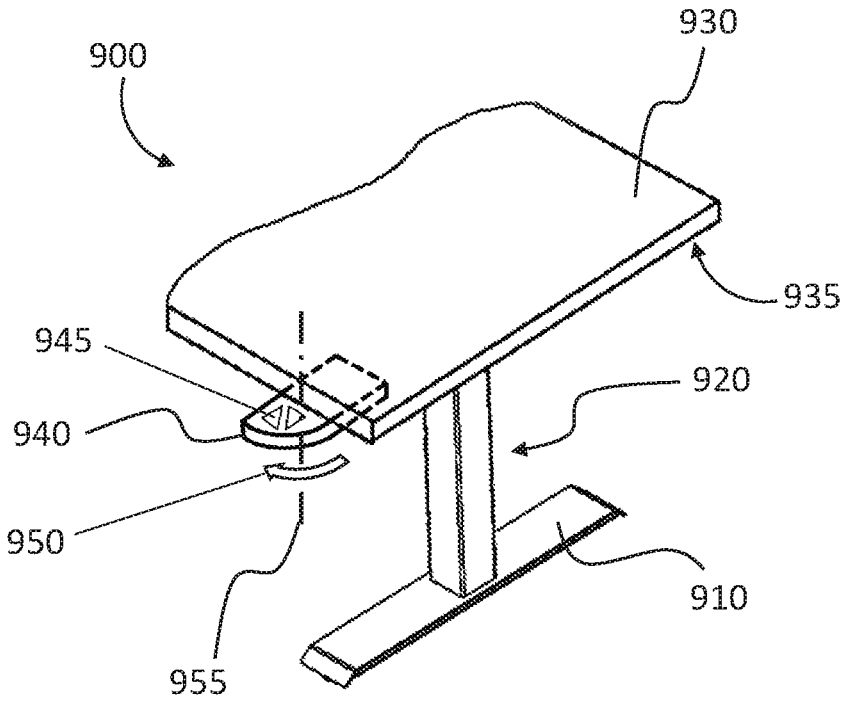
FIG. 8 is a perspective view of a section of a height adjustable workstation with another example of a mechanically actuated connector for height adjustment.

FIG. 8 is a perspective view of another example of a mechanically actuated connector. A section of a height adjustable workstation 900 is illustrated in FIG. 8. The height adjustable workstation 900 can have at least one leg assembly including a base 910, a support leg 920, and a work surface 930. The workstation 900 can have a mechanically actuated connector 940. The mechanically actuated connector 940 can be attached to an underside 935 of the work surface 930. The mechanically actuated connector 940 can be rotatingly coupled to the work surface 930. The rotation axis 955 of the mechanically actuated connector 940 can be perpendicular to the work surface 930. The mechanically actuated connector 940 can rotate in a first direction 950 to be in a connected state and rotate in a second direction opposite the first direction 950 to be in a disconnected state.

When the mechanically actuated connector 940 is retracted (e.g., rotate in a second direction opposite the first direction 950 to be stowed under the work surface 930), the mechanically actuated connector 940 can be in the disconnected state. In the disconnected state, no power can be supplied to the controller 700. When the mechanically actuated connector 940 is extracted (e.g., rotate in the first direction 950 to be at least partially pulled out from under the work surface 930), the mechanically actuated connector 940 can be in the connected state. In the connected state, electric power can be supplied to the controller 700. When the mechanically actuated connector 940 is manipulated (e.g., rotated in a first direction 950) to achieve a connected state, a height adjustment user interface 945 can also be exposed, e.g., simultaneously, allowing the user to adjust a height of the work surface 930. For example, the height adjustment user interface 945 can be coupled to the mechanically actuated connector 940, e.g., a top surface of the connector 940, such that when the connector 940 is rotated in the direction 950, the user interface 945 is revealed to the user.

Figure 9A:
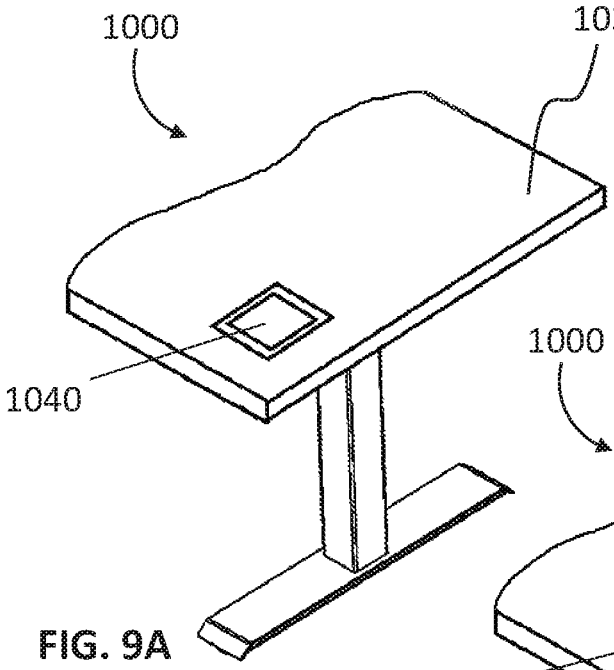
FIGS. 9A and 9B are a perspective view of a section of a height adjustable workstation with yet another example of a mechanically actuated connector for height adjustment.
Figure 9B:
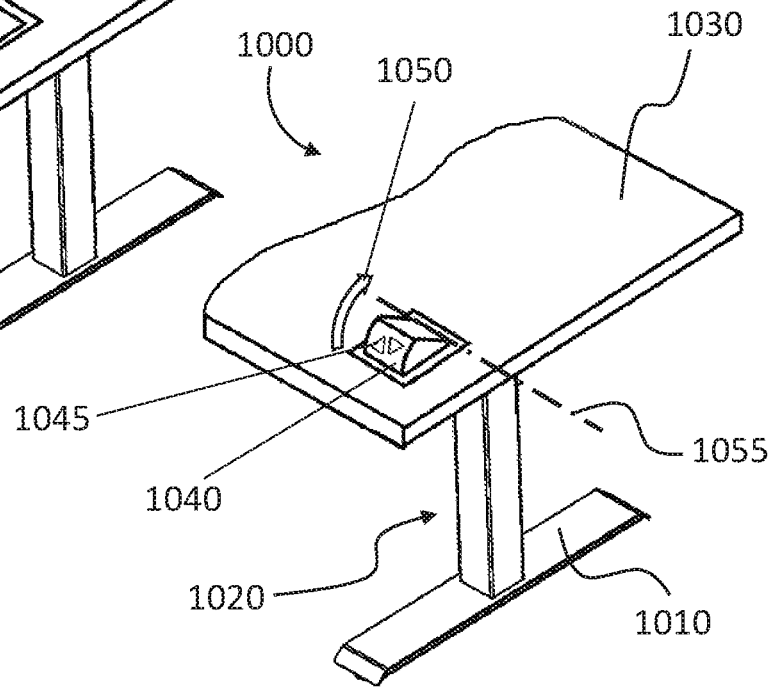

FIGS. 9A and 9B are perspective views of another example of a mechanically actuated connector. A section of a height adjustable workstation 1000 is illustrated in FIGS. 9A and 9B. The height adjustable workstation 1000 can have at least one leg assembly including a base 1010, a support leg 1020, and a work surface 1030. The workstation 1000 can have a mechanically actuated connector 1040. The mechanically actuated connector 1040 can be attached to the work surface 1030. The mechanically actuated connector 1040 can be rotatingly coupled to the work surface 1030. The rotation axis 1055 of the mechanically actuated connector 1040 can be parallel to an edge of the mechanically actuated connector 1040, and the rotation axis 1055 can be located on a plane parallel to the work surface 1030. The mechanically actuated connector 1040 can rotate in a first direction 1050 to be in a connected state and rotate in a second direction opposite the first direction 1050 to be in a disconnected state.

When the mechanically actuated connector 1040 is retracted (e.g., rotated in a second direction opposite the first direction 1050 to be stowed), the mechanically actuated connector 1040 can be in the disconnected state. In the disconnected state (e.g., the stowed position of the mechanically actuated connector 1040), a surface of the mechanically actuated connector 1040 can be leveled with the work surface 1030 as illustrated in FIG. 9A. In the disconnected state, no power can be supplied to the controller 700. When the mechanically actuated connector 1040 is extracted (e.g., rotated in the first direction 1050 to be at least partially exposed above the work surface 1030 as illustrated in FIG. 9B), the mechanically actuated connector 1040 can be in the connected state. In the connected state, electric power can be supplied to the controller 700. When the mechanically actuated connector 1040 is manipulated (e.g., rotated in a first direction 1050) to achieve a connected state, a height adjustment user interface 1045 can also be exposed, e.g., simultaneously, allowing the user to adjust a height of the work surface 1030. For example, the height adjustment user interface 1045 can be coupled to the mechanically actuated connector 1040, e.g., a front surface of the connector 1040, such that when the connector 1045 is rotated in the direction 1050, the user interface 1045 is revealed to the user.

Figure 10A:
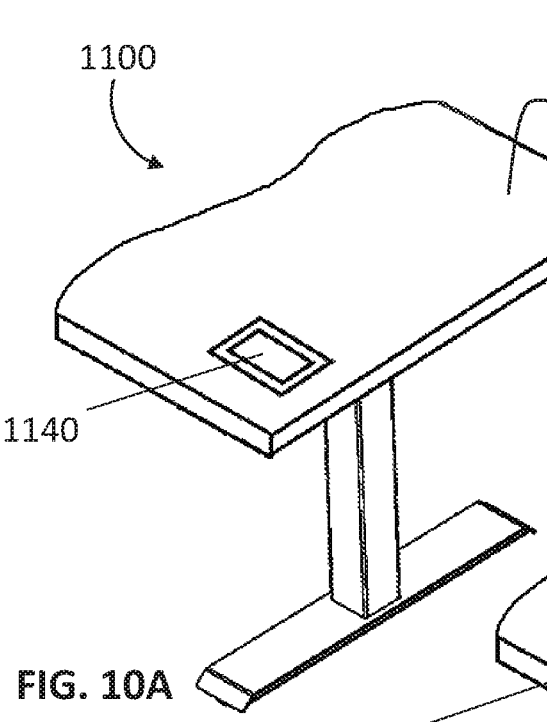
FIGS. 10A and 10B are a perspective view of a section of a height adjustable workstation with yet another example of a mechanically actuated connector for height adjustment.
Figure 10B:
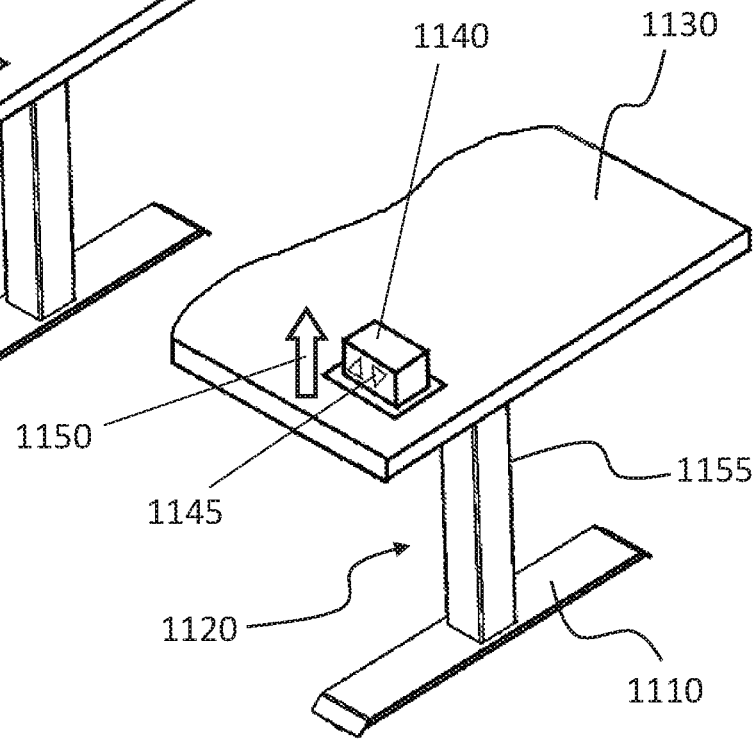

FIGS. 10A and 10B are perspective views of another example of a mechanically actuated connector. A section of a height adjustable workstation 1100 is illustrated in FIGS. 10A and 10B. The height adjustable workstation 1100 can have at least one leg assembly including a base 1110, a support leg 1120, and a work surface 1130. The workstation 1100 can have a mechanically actuated connector 1140. The mechanically actuated connector 1140 can be attached to the work surface 1130. The mechanically actuated connector 1140 can be slidingly coupled to the work surface 1130. The mechanically actuated connector 1140 can slide in a first direction 1150 to be in a connected state and slide in a second direction opposite the first direction 1050 to be in a disconnected state. The first direction 1150 can be in general perpendicular to the work surface 1130.

When the mechanically actuated connector 1140 is retracted (e.g., slide in a second direction opposite the first direction 1050 to be stowed), the mechanically actuated connector 1140 can be in a disconnected state. In the disconnected state (i.e., in stowed position of the mechanically actuated connector 1140), a surface of the mechanically actuated connector 1040 can be leveled with the work surface 1130 as illustrated in FIG. 10A. In the disconnected state, no power can be supplied to the controller 700. When the mechanically actuated connector 1140 is extracted (e.g., slide in the first direction 1050 to be at least partially exposed above the work surface 1130 as illustrated in FIG. 10B), the mechanically actuated connector 1140 can be in a connected state. In the connected state, electric power can be supplied to the controller 700. When the mechanically actuated connector 1140 is manipulated (e.g., slide in a first direction 1150) to achieve a connected state, a height adjustment user interface 1145 can also be exposed, e.g., simultaneously, allowing the user to adjust a height of the work surface 1130. For example, the height adjustment user interface 1145 can be coupled to the mechanically actuated connector 1140, e.g., a front surface of the connector 1140, such that when the connector 1140 is moved in the direction 1150, the user interface 1145 is revealed to the user.

Figure 11:
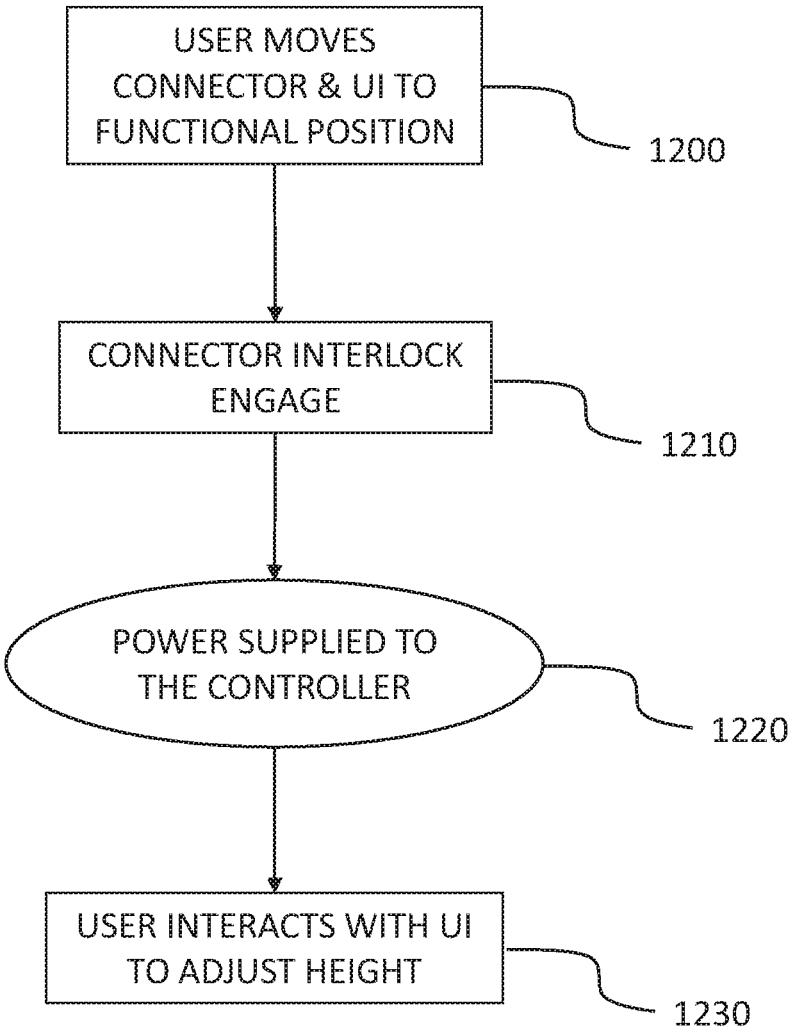
FIG. 11 is a representation of the process flow to connect the power to the height adjustment mechanism and adjust the height of the work surface.

FIG. 11 is an example of a flow diagram to connect power and to activate the height adjustment mechanism of a height adjustable workstation in accordance with various techniques of this disclosure. These process steps can be applicable to any of the example workstations using any of the examples of mechanically actuated connectors described in this disclosure. At block 1200, a user of a height adjustable workstation can manipulate a mechanically actuated connector located on the workstation to a functional position, where the functional position can correspond to a connected state. At block 1210, in the connected state, the connector can engage and can provide power to a controller connected to the height adjustable workstation. The controller can include an AC/DC converter, a height adjustment controller, and a timer controller. When the mechanically actuated connector is moved to a functional position or connected state, a user interface comprising a pair of height adjustment control buttons can be exposed. At block 1220, the user interface can be connected to the height adjustment controller and power can be supplied to the controller. At block 1230, the user of the workstation can interact with the height adjustment control buttons to adjust a height of the worksurface.

Figure 12:
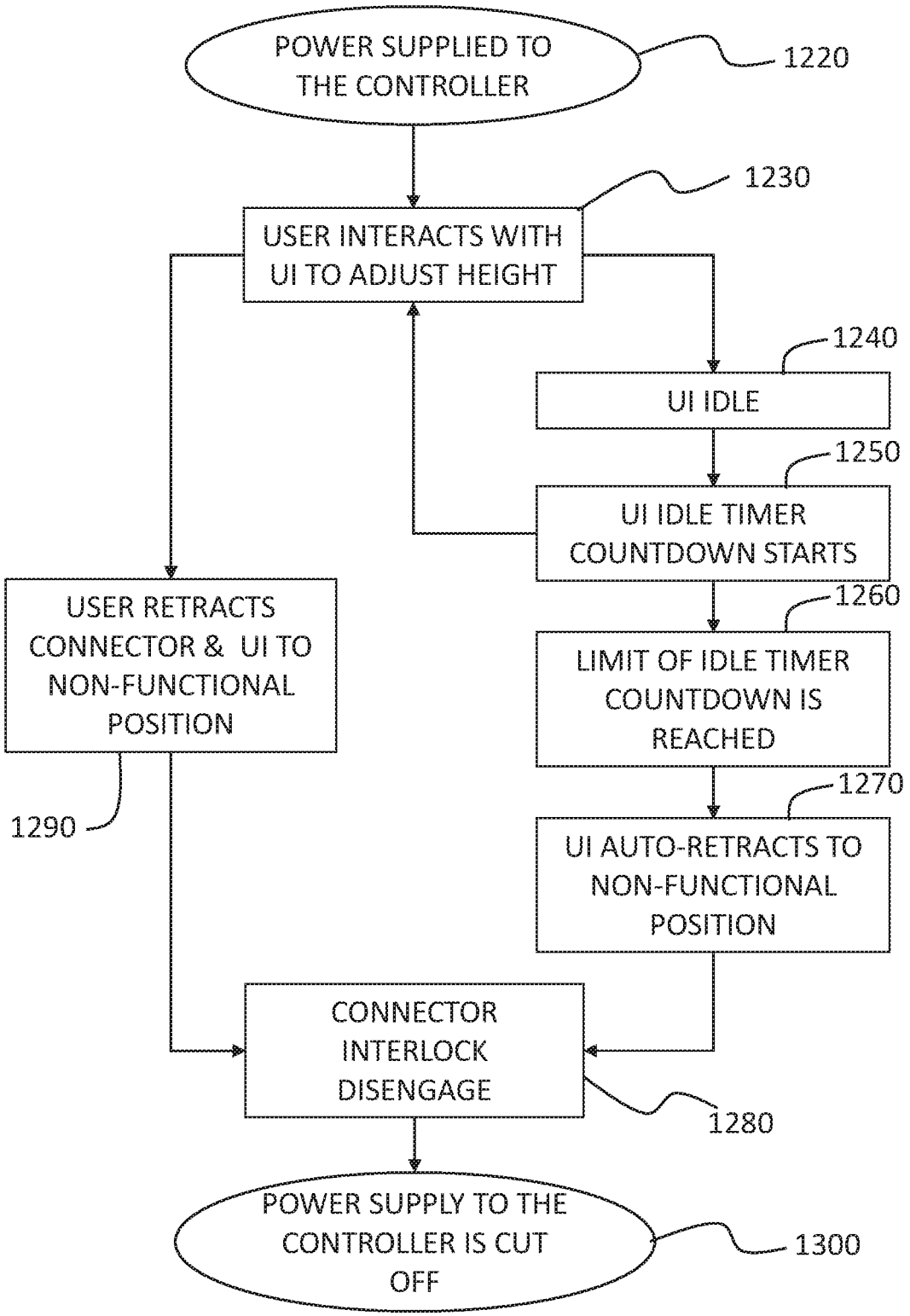
FIG. 12 is a representation of the process flow to disconnect the power from the height adjustment mechanism when the height adjustment mechanism is idle.

FIG. 12 is a flow diagram depicting an example of a process of disconnecting the power to the height adjustment mechanism of a height adjustable workstation in accordance with various techniques of this disclosure. At block 1220 (also shown in FIG. 11), the power is connected to the controller. At block 1230 (also shown in FIG. 11), the user of the workstation can interact with the user interface to adjust a height of the worksurface.

At block 1240, if the height adjustment mechanism is idle or inactive for a pre-set period of time, a user interface idle timer starts a countdown at block 1250. In some example applications, a user of the workstation can have additional interactions with the user interface (block 1230) before a limit of the idle timer countdown is reached. In such applications when user interacts with the user interface, the allowed pre-set inactive period and the subsequent user interface idle timer countdown restarts.

At block 1260, if there are no additional interaction with the user interface before the limit of the user interface idle timer countdown is reached, the connector and the user interface can auto-retract to a non-functional position, where the non-functional position can correspond to a disconnected state. At block 1280, in the disconnected state, the connector can disengage. At block 1300, in response to the connector disengaging, all the electric power to the controller can be removed or cut-off.

In some example applications, after the power is connected to the height adjustment controller (block 1220) and the user of the workstation interacted with the user interface to adjust a height of the worksurface (block 1230), at block 1290 the user can manually retract the connector and the user interface to a non-functional position, where the non-functional position can correspond to a disconnected state. At block 1280, in the disconnected state, the connector can disengage. At block 1300, in response to the connector disengaging, the power supply to the controller can be removed or cut off.

Figure 13:
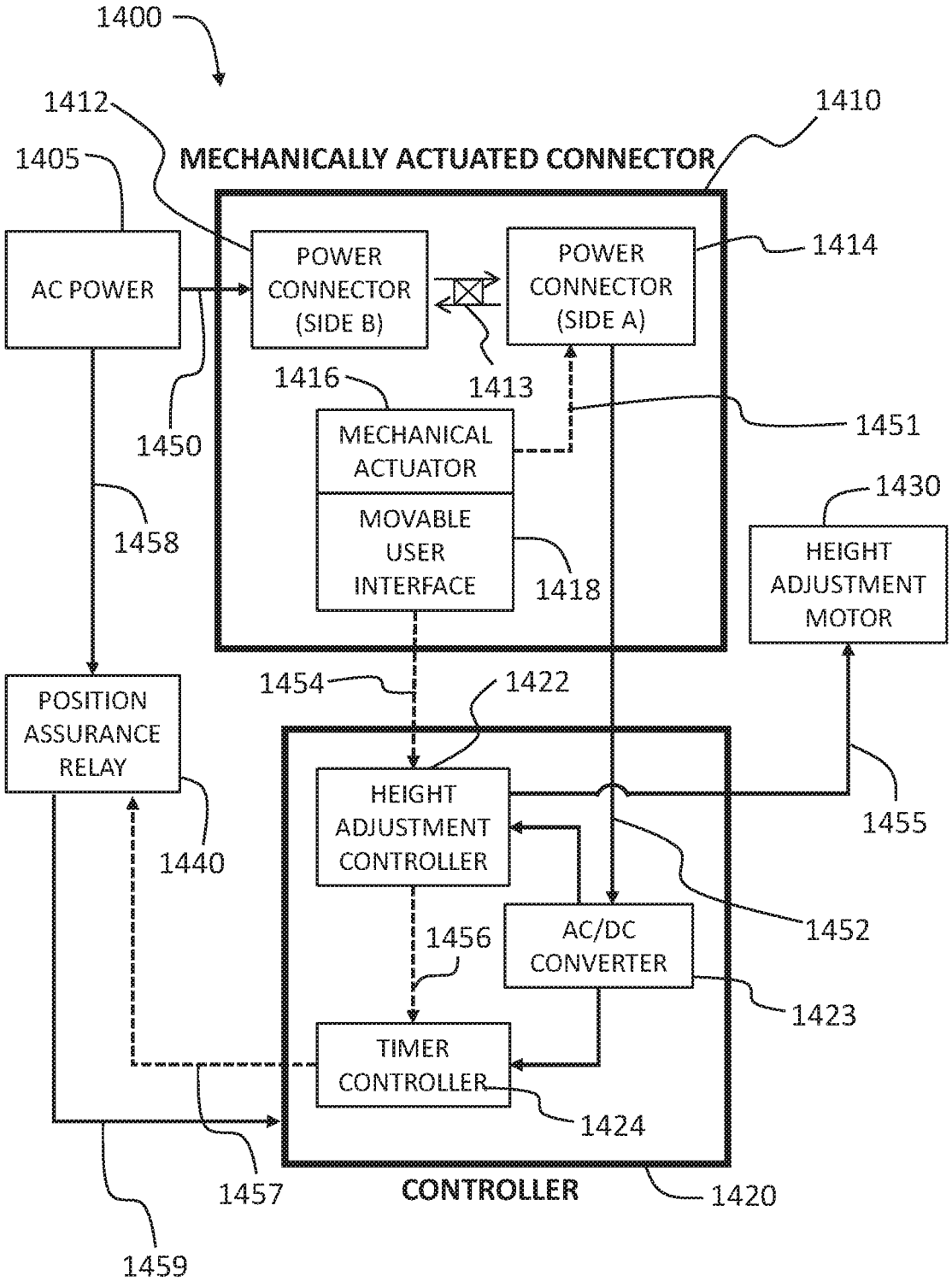
FIG. 13 is a block diagram representing various components of the electrical system for height adjustment mechanism.

FIG. 13 is a block diagram illustrating various components of an example of an electro-mechanical system 1400 that can adjust a height of the worksurface. The electro-mechanical system 1400 can include an AC power supply 1405, a mechanically actuated connector 1410, a controller 1420, an electric motor 1430, and a position assurance relay 1440. Power and various signals can flow among components of the electro-mechanical system 1400 to provide power to the electric motor 1430 and interact with the electric motor to drive a linear actuator to selectively adjust a height of a workstation.

The mechanically actuated connector 1410 can include a mechanical actuator 1416 and a power connector, where the power connector can have two sides including a power connector side A 1412 and a power connector side B 1414.

At least one of the power connector side A or the power connector side B can be coupled to the mechanical actuator 1416. The user of the workstation can manipulate the mechanical actuator, e.g., slide, rotate, or elevate, or the like, to move at least one of the power connector side A or the power connector side B.

Figure 14:
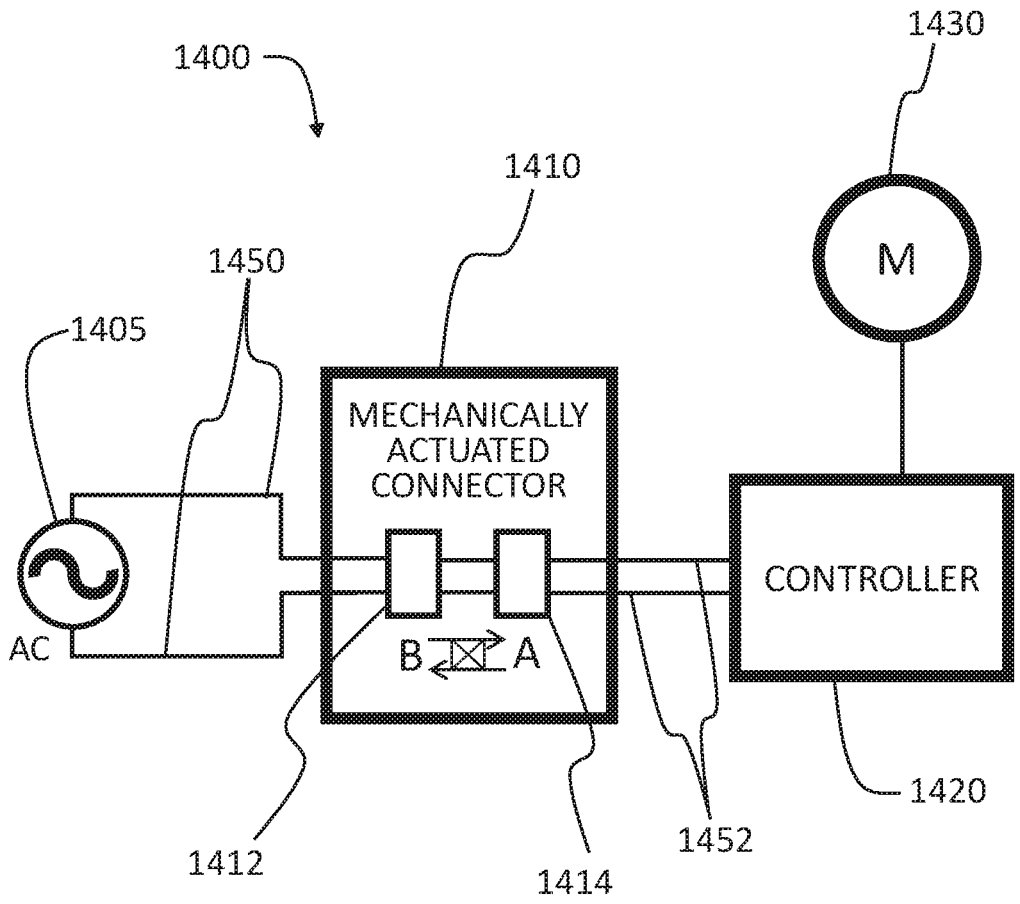
FIG. 14 is a circuit diagram of the electrical system for the height adjustment mechanism.

FIG. 14 is an example of a block diagram showing connections between a mechanically actuated connected, an AC power source, and a motor. In the example configuration illustrated in FIG. 14, the AC power source 1405 can be connected to the power connector side B 1412 via a power line 1450, and the power connector side A 1414 can be coupled to the mechanical actuator 1416. The user of the workstation can manipulate the mechanical actuator 1416 to move the power connector side A 1414 to create contact between the power connector side A 1414 and the power connector side B 1412. The connector can further include a connector interlock (1413). The connector interlock 1413 can mechanically secure the connection between side A and side B, and can prevent unintentional detachment of the power connector side A from the power connector side B. The connector interlock 1413 can be a mechanical attachment including, but not limited to, a latch, a friction connection, or others. In some examples, the connector interlock 1413 can require a high force, e.g., 1 to 5 kilograms, or manipulation of a feature, e.g. a tab, to separate. When the power connector side A 1414 and side B 1412 contact each other, the connector interlock 1413 can engage and the AC power can flow from power connector side B 1412 to side A 1414. When the AC power flows to the power connector side A. AC power can also be provided to the controller 1420 via the power line 1452.

Referring again to FIG. 13, the controller 1420 of the electro-mechanical system 1400 can include an AC/DC converter 1423, a height adjustment controller 1422, and a timer controller 1424 according to an example configuration of the current disclosure. When the connector interlock 1413 engages (e.g., in the connected state), AC power can be supplied to the AC/DC converter 1423, and it can be converted to a DC power. The AC/DC converter 1423 can provide DC power to the height adjustment controller 1422, and the timer controller 1424.

The mechanically actuated connector 1410 of FIG. 13 can further include a user interface 1418. The user interface 1418 can be coupled to the mechanical actuator 1416. When the user of the workstation manipulates the mechanical actuator 1416 to connect power connector side A 1414 and side B 1412, the user interface 1418 can also move, e.g., simultaneously, with the mechanical actuator 1416. Movement of the mechanical actuator 1416 can expose the user interface 1418. Once the user interface 1418 is exposed, the user of the workstation can interact with the user interface 1418 to send signals to the controller 1420 to operate the motor 1430 for adjusting the height of the worksurface.

The height adjustment controller 1422 can receive a control signal from the user interface 1418 via a signal line 1454. The control signal can indicate which direction the user wants to move the work surface (e.g., up or down). In response to the control signal received, the height adjustment controller 1422 can supply power to the motor 1430 via a power line 1455 to drive a linear actuator (not shown) connected to the motor 1430 and move the work surface in a desired direction (e.g., up or down).

The timer controller 1424 can monitor, e.g., periodically or continuously, if the user has interacted with the user interface 1418 to adjust the height of the work surface. If there has been no interaction with the user interface for a pre-set period of time, the timer controller 1424 can initiate a timer countdown. When a limit of the timer countdown is reached, the timer controller 1424 can start auto-retracting the mechanically actuated connector 1410 to a non-functional position to disconnect power from the controller 1420. The non-functional position of the mechanically actuated connector 1410 can correspond to a disconnected state. In the disconnected state, power connector side A 1414 can be disconnected from the power connector side B 1412, thereby removing the AC power from the controller 1420.

Figure 15:
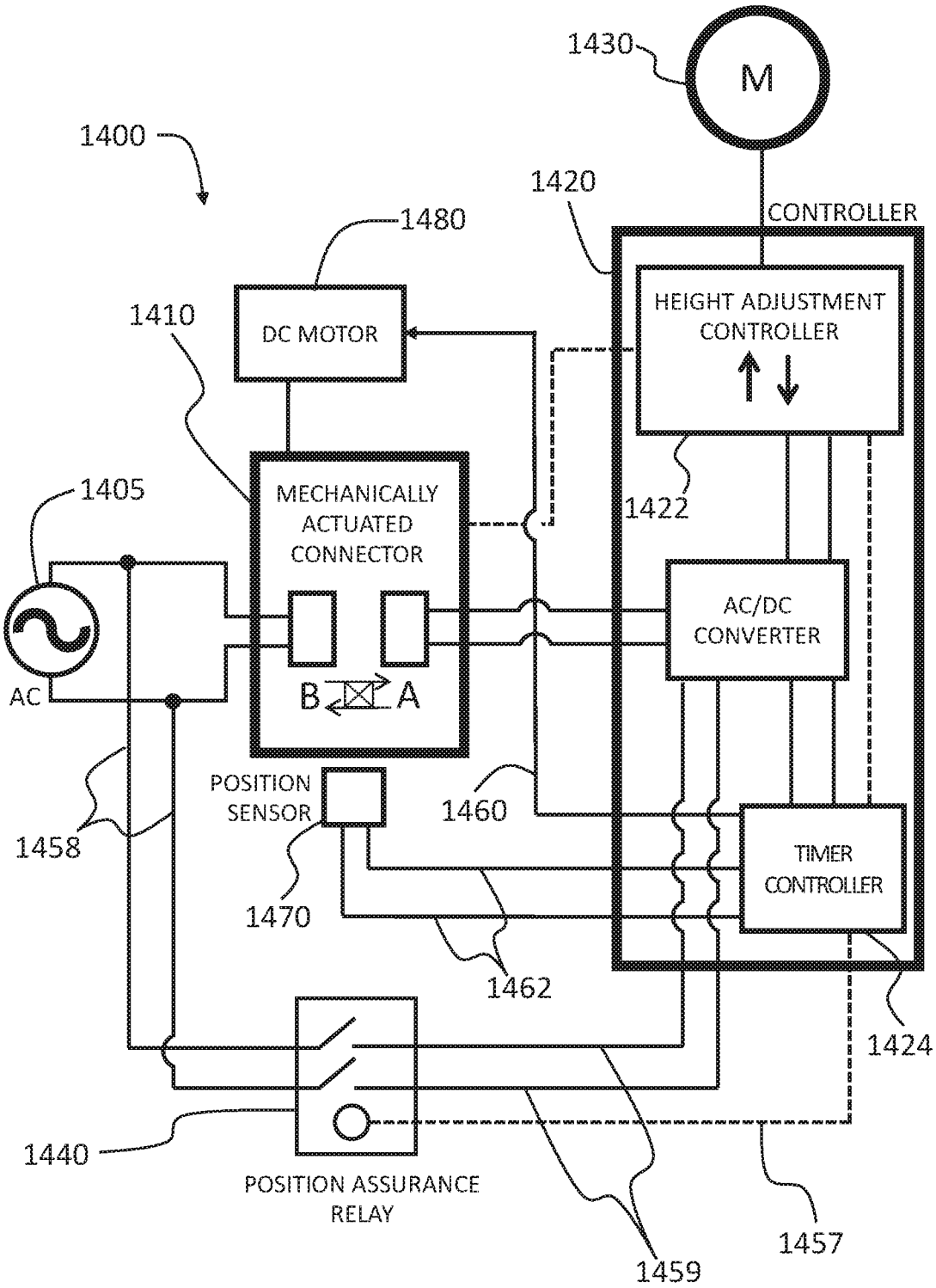
FIG. 15 is the circuit diagram of the electrical system for the height adjustment mechanism, with details of the controller.

FIG. 15 is another block diagram illustrating various additional components of the electro-mechanical system 1400 that can adjust a height of the worksurface. The electro-mechanical system 1400 of FIGS. 13 and 14 can further include a position assurance relay 1440, a position sensor 1470, and a DC motor as illustrated in FIG. 15 according to an example configuration of the current disclosure. The position sensor 1470 can be connected to the timer controller 1424, and it can detect the position of power connector side A 1414 and power connector side B 1412 relative to each other to determine when they are disconnected. The DC motor 1480 can be connected to the mechanically actuated connector 1410. When it is powered by the timer controller 1424 via a power line 1460, the DC motor 1480 can retract the mechanically actuated connector 1410 to the disconnected position.

When the limit of the timer countdown is reached, the timer controller 1424 can initiate auto-retraction of the mechanically actuated connector 1410 to a non-functional position to disconnect power from the controller 1420. In some example configurations, the timer controller 1424 can also activate the position assurance relay 1440. The position assurance relay 1440 can be connected to the AC power source via the power line 1458. Once the position assurance relay 1440 is activated, AC power can be provided to the AC/DC converter via a power line 1459 during auto-retraction of the mechanically actuated controller 1410 to the non-functional position.

The timer controller 1424 can continuously monitor the position of the power connector side A 1414 and power connector side B 1412 during the auto-retraction of the mechanically actuated controller 1410 using the position sensor 1470. When it is determined that power connector side A 1414 and side B 1412 are in a fully retracted position, the timer controller 1424 can deactivate the position assurance relay 1440 to remove the remaining power to the controller 1420 via the position assurance relay 1440.

ADDITIONAL NOTES AND ASPECTS

Aspect 1 may include or use subject matter (such as an apparatus, a system, a device, a method, a means for performing acts, or a device readable medium including instructions that, when performed by the device, may cause the device to perform acts), such as may include or use a height adjustable workstation, comprising: a worksurface; a support leg coupled to the worksurface; an electric motor coupled to the support leg, wherein the electric motor is configured to translate a movable portion of the support leg relative to a stationary portion of the support leg; a mechanically actuated connector comprising: a connector interlock, wherein the connector interlock is engaged when first and second sides of the mechanically actuated connector contact each other, and wherein the connector interlock is disengaged when the first and second sides do not contact each other, a controller configured to be connected to a power source via the mechanically actuated connector, the controller comprising: a height adjustment controller connected to an electric motor, wherein the controller is connected to the power source when the connector interlock is engaged, and wherein the controller is disconnected from the power source when the connector interlock is disengaged, and wherein the height adjustment controller is configured to control the electric motor to drive the movable portion to change a height of the worksurface when the connector interlock is engaged.

Aspect 2 may include or use, or may optionally be combined with the subject matter of Aspect 1, to optionally include or use wherein the support leg is a fixed height riser.

Aspect 3 may include or use, or may optionally be combined with the subject matter of Aspect 1, to optionally include or use wherein the support leg is a telescoping riser.

Aspect 4 may include or use, or may optionally be combined with the subject matter of Aspects 1 through 3, to optionally include or use wherein the stationary portion is supported by a structure, wherein the movable portion is slidingly engaged with the stationary portion.

Aspect 5 may include or use, or may optionally be combined with the subject matter of Aspects 1 through 4, to optionally include or use a base, wherein the stationary portion is supported by the base, and wherein the movable portion is slidingly engaged with the stationary portion.

Aspect 6 may include or use, or may optionally be combined with the subject matter of Aspects 1 through 5, to optionally include or use wherein the electric motor is coupled between the stationary portion and the movable portion, wherein the electric motor is configured to drive the movable portion to change a height of the worksurface.

Aspect 7 may include or use, or may optionally be combined with the subject matter of Aspects 1 through 6, to optionally include or use a timer controller configured to cause the connector interlock to disengage when the timer reaches a limit.

Aspect 8 may include or use, or may optionally be combined with the subject matter of Aspects 1 through 7, to optionally include or use wherein the support leg is a linkage assembly coupled between a base and the worksurface.

Aspect 9 may include or use, or may optionally be combined with the subject matter of Aspect 8, to optionally include or use wherein the stationary portion is a worksurface, wherein the movable portion is a moving bracket, and wherein the linkage assembly further comprises: a parallel linkage assembly having a proximal end and a distal end; a transverse linkage having a first end and a second end; and the moving bracket slidingly engaged with the worksurface, wherein the parallel linkage assembly is rotatingly coupled with the base at the proximal end, and rotatingly coupled with the moving bracket at the distal end, and wherein the transverse linkage is rotatingly coupled to the worksurface at the first end of the transverse linkage, and rotatingly coupled with the parallel linkage assembly at the second end of the transverse linkage. Aspect may include or use, or may optionally be combined with the subject matter of Aspect 9, to optionally include or use an electric motor connected to the worksurface and the moving bracket.

Aspect 11 may include or use, or may optionally be combined with the subject matter of Aspect 1, to optionally include or use wherein the first side of the mechanically actuated connector is configured to move in a first direction to engage with the second side of the mechanically actuated connector, and is further configured to move in a second direction opposite the first direction to disconnect from the second side of the mechanically actuated connector.

Aspect 12 may include or use, or may optionally be combined with the subject matter of Aspect 1, to optionally include or use wherein the first side of the mechanically actuated connector is configured to rotate in a first direction to engage with the second side of the mechanically actuated connector, and further configured to rotate in a second direction opposite the first direction to disconnect from the second side of the mechanically actuated connector.

Aspect 13 may include or use, or may optionally be combined with the subject matter of Aspect 1, to optionally include or use wherein the mechanically actuated connector further includes a user interface.

Aspect 14 may include or use, or may optionally be combined with the subject matter of Aspect 1, to optionally include or use wherein the user interface is exposed when the mechanically actuated connector is in the connected state and hidden when the mechanically actuated connector is in the disconnected state.

Aspect 15 may include or use subject matter (such as an apparatus, a system, a device, a method, a means for performing acts, or a device readable medium including instructions that, when performed by the device, may cause the device to perform acts), such as may include or use a height adjustable workstation, comprising: a worksurface; a riser coupled to the worksurface; an electric motor coupled to the riser, wherein the electric motor is configured to drive a second member of the riser slidingly engaged with a first member of the riser to change a height of the worksurface; a mechanically actuated connector comprising: a connector interlock, wherein the connector interlock is engaged when first and second sides of the mechanically actuated connector contact each other, and wherein the connector interlock is disengaged when the first and second sides do not contact each other, a controller configured to be connected to a power source via the mechanically actuated connector, the controller comprising: a height adjustment controller connected to an electric motor; and a timer controller including a timer, wherein the controller is connected to the power source when the connector interlock is engaged, and the controller is disconnected from the power source when the connector interlock is disengaged, wherein the timer controller is configured to cause the connector interlock to disengage when the timer reaches a limit, and wherein the height adjustment controller is configured to control the electric motor to drive the second member to change a height of the worksurface when the connector interlock is engaged.

Aspect 16 may include or use subject matter (such as an apparatus, a system, a device, a method, a means for performing acts, or a device readable medium including instructions that, when performed by the device, may cause the device to perform acts), such as may include or use a height adjustable workstation, comprising a worksurface; a base; a telescoping riser coupled to the worksurface; an electric motor coupled to first and second members of the telescoping riser, wherein the electric motor is configured to drive the second member to change a height of the worksurface; a mechanically actuated connector comprising: a connector interlock, wherein the connector interlock is engaged when first and second sides of the mechanically actuated connector contact each other, and wherein the connector interlock is disengaged when the first and second sides do not contact each other, a controller comprising: a height adjustment controller connected to the electric motor, and a timer controller including a timer, wherein the controller is connected to a power source via the mechanically actuated controller, wherein the controller is connected to the power source when the connector interlock is engaged, and the controller is disconnected from the power source when the connector interlock is disengaged, wherein the timer controller is configured to cause the connector interlock to disengage when the timer reaches a limit, and wherein the height adjustment controller is configured to control the electric motor to drive the second member to change a height of the worksurface when the connector interlock is engaged.

Aspect 17 may include or use subject matter (such as an apparatus, a system, a device, a method, a means for performing acts, or a device readable medium including instructions that, when performed by the device, may cause the device to perform acts), such as may include or use a height adjustable workstation, comprising: a worksurface; a base; a leg assembly coupled to the worksurface, the leg assembly comprising: a parallel linkage assembly having a proximal end and a distal end; a transverse linkage having a first end and a second end; and a moving bracket slidingly engaged with the work surface, wherein the parallel linkage is rotatingly coupled with the base at the proximal end, and rotatingly coupled with the moving bracket at the distal end, wherein the transverse linkage is rotatingly coupled to the work surface at the first end of the transverse linkage, and rotatingly coupled with the parallel linkage assembly at the second end of the transverse linkage, an electric motor connected to the worksurface and the moving bracket, a mechanically actuated connector comprising: a connector interlock, wherein the connector interlock is engaged when first and second sides of the mechanically actuated connector contact each other, and wherein the connector interlock is disengaged when the first and second sides do not contact each other, a controller configured to be connected to a power source via the mechanically actuated connector, the controller comprising: a height adjustment controller connected to the electric motor; and a timer controller including a timer, wherein the controller is connected to the power source when the connector interlock is engaged, and the controller is disconnected from the power source when the connector interlock is disengaged, wherein the timer controller is configured to cause the connector interlock to disengage when the timer reaches a limit, and wherein the height adjustment controller is configured to control the electric motor to drive the moving bracket to change a height of the work surface when the mechanically actuated controller is in the connected state.

Each of these non-limiting examples can stand on its own or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first." "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

The claimed invention is:

1. A height adjustable workstation, comprising:

a worksurface;

a support leg coupled to the worksurface;

an electric motor coupled to the support leg, wherein the electric motor is configured to translate a movable portion of the support leg relative to a stationary portion of the support leg;

a power source;

a mechanically actuated connector coupled to the worksurface and connected to the power source, the mechanically actuated connector comprising:

a first power connector connected to the power source;

a second power connector spaced apart from the first power connector; and a connector interlock operational between an engaged position and a disengaged position, in the engaged position, the connector interlock connects the first power connector and the second power connector, and in the disengaged position, the connector interlock disconnects the first power connector and the second power connector; and a controller connected to the second power connector and configured to be connected to the power source via the mechanically actuated connector, the controller comprising:

a height adjustment controller connected to the electric motor;

wherein:

in the engaged position, the connector interlock connects the controller to the power source to power the height adjustment controller such that the height adjustment controller controls the electric motor to drive the movable portion to change a height of the worksurface; and in the disengaged position, the connector interlock disconnects the controller and the power source.

2. The height adjustable workstation of claim 1, wherein the support leg is a fixed height riser.

3. The height adjustable workstation of claim 1, wherein the support leg is a telescoping riser.

4. The height adjustable workstation of claim 1, wherein the stationary portion is supported by a structure, wherein the movable portion is slidingly engaged with the stationary portion.

5. The height adjustable workstation of claim 1, further comprising:

a base, wherein the stationary portion is supported by the base, and wherein the movable portion is slidingly engaged with the stationary portion.

6. The height adjustable workstation of claim 5, wherein the electric motor is coupled between the stationary portion and the movable portion, wherein the electric motor is configured to drive the movable portion to change a height of the worksurface.

7. The height adjustable workstation of claim 1, wherein the controller further comprises:

a timer controller, including a timer, the timer controller configured to cause the connector interlock to disengage when the timer reaches a limit.

8. The height adjustable workstation of claim 1, wherein the support leg is a linkage assembly coupled between a base and the worksurface.

9. The height adjustable workstation of claim 8, wherein the stationary portion is a worksurface, wherein the movable portion is a moving bracket, and wherein the linkage assembly further comprises:

a parallel linkage assembly having a proximal end and a distal end;

a transverse linkage having a first end and a second end; and the moving bracket slidingly engaged with the worksurface, wherein the parallel linkage assembly is rotatably coupled with the base at the proximal end, and rotatably coupled with the moving bracket at the distal end, and wherein the transverse linkage is rotatably coupled to the worksurface at the first end of the transverse linkage, and rotatably coupled with the parallel linkage assembly at the second end of the transverse linkage.

10. The height adjustable workstation of claim 9, further comprising an electric motor connected to the worksurface and the moving bracket.

11. The height adjustable workstation of claim 1, wherein the first power connector of the mechanically actuated connector is configured to move in a first direction to engage with the second power connector of the mechanically actuated connector, and is further configured to move in a second direction opposite the first direction to disconnect from the second power connector of the mechanically actuated connector.

12. The height adjustable workstation of claim 1, wherein the first power connector of the mechanically actuated connector is configured to rotate in a first direction to engage with the second power connector of the mechanically actuated connector, and further configured to rotate in a second direction opposite the first direction to disconnect from the second power connector of the mechanically actuated connector.

13. The height adjustable workstation of claim 1, wherein the mechanically actuated connector further includes a user interface.

14. The height adjustable workstation of claim 13, wherein the user interface is exposed when the mechanically actuated connector is in the engaged position and hidden when the mechanically actuated connector is in the disengaged position.

15. A height adjustable platform, comprising:

a support bracket;

a riser coupled to the support bracket;

an electric motor coupled to the riser, wherein the electric motor is configured to drive a second member of the riser slidingly engaged with a first member of the riser to change a height of the support bracket;

a power source;

a mechanically actuated connector connected to the power source, the mechanically actuated connector comprising:

a first power connector connected to the power source;

a second power connector spaced apart from the first power connector; and a connector interlock operational between an engaged position and a disengaged position, in the engaged position the connector interlock connects the first power connector and the second power connector, and in the disengaged position, the connector interlock disconnects the first power connector and the second power connector; and a controller connected to the second power connector and configured to be connected to the power source via the mechanically actuated connector, the controller comprising:

a height adjustment controller connected to the electric motor; and a timer controller including a timer;

wherein:

in the engaged position, the connector interlock connects the controller to the power source to power the height adjustment controller such that the height adjustment controller controls the electric motor to drive the second member to change a height of the support bracket;

in the disengaged position, the connector interlock disconnects the controller and the power source; and the timer controller is configured to move the connector interlock into the disengaged position when the timer reached a limit.

16. A height adjustable support bracket-, comprising:

a support bracket;

a base;

a telescoping riser coupled to the support bracket;

an electric motor coupled to a first member and a second member of the telescoping riser, wherein the electric motor is configured to drive the second member to change a height of the support bracket;

a power source;

a mechanically actuated connector connected to the power source, the mechanically actuated connector comprising:

a first power connector connected to the power source;

a second power connector spaced apart from the first power connector; and a connector interlock operational between an engaged position and a disengaged position, in the engaged position the connector interlock connects the first power connector and the second power connector, and in the disengaged position, the connector interlock disconnects the first power connector and the second power connector; and a controller connected to the second power connector and configured to be connected to the power source via the mechanically actuated connector, the controller comprising:

a height adjustment controller connected to the electric motor, and a timer controller including a timer;

wherein:

in the engaged position, the connector interlock connects the controller to the power source to power the height adjustment controller such that the height adjustment controller controls the electric motor to drive the second member to change a height of the support bracket;

in the disengaged position, the connector interlock disconnects the controller and the power source; and the timer controller is configured to move the connector interlock into the disengaged position when the timer reached a limit.

17. A height adjustable support bracket-, comprising:

a support bracket;

a base;

a leg assembly coupled to the support bracket, the leg assembly comprising:

a parallel linkage assembly comprising:

a proximal end rotatably coupled to the base; and a distal end;

a transverse linkage comprising:

a first end rotatably coupled to the support bracket; and a second end rotatably coupled to the parallel linkage assembly;

a moving bracket rotatably coupled to the distal end of the parallel linkage assembly and slidingly engaged with the support bracket;

an electric motor connected to the support bracket and the moving bracket;

a power source;

a mechanically actuated connector connected to the power source, the mechanically actuated connector comprising:

a first power connector connected to the power source;

a second power connector spaced apart from the first power connector; and a connector interlock operational between an engaged position and a disengaged position, in the engaged position the connector interlock connects the first power connector and the second power connector, and in the disengaged position, the connector interlock disconnects the first power connector and the second power connector; and a controller connected to the second power connector and configured to be connected to a power source via the mechanically actuated connector, the controller comprising:

a height adjustment controller connected to the electric motor; and a timer controller including a timer;

wherein:

in the engaged position, the connector interlock connects the controller to the power source to power the height adjustment controller such that the height adjustment controller controls the electric motor to drive the moving bracket to change a height of the support bracket;

in the disengaged position, the connector interlock disconnects the controller and the power source; and the timer controller is configured to move the connector interlock into the disengaged position when the timer reached a limit.

* * * * *